United States Patent [19]

Jamison

[11] Patent Number: 4,685,572

[45] Date of Patent: Aug. 11, 1987

[54] ANTI-THEFT DEVICE, IS PARTICULAR FOR A GARMENT-HANGER

[76] Inventor: Timothy Jamison, 85, Chemin des Hauts de Grisy, F - 78450 Villepreux, France

[21] Appl. No.: 819,802

[22] Filed: Jan. 16, 1986

[51] Int. Cl.[4] ..... A47G 25/14; A47G 25/48

[52] U.S. Cl. ..... 211/4; 211/8; 223/85; 223/93; 223/96; 70/59

[58] Field of Search ..... 211/4, 7, 8; 70/59, 70/60, 57, 58; 223/85, 92, 93, 95, 96

[56] References Cited

U.S. PATENT DOCUMENTS

| | | | |
|---|---|---|---|
| 1,713,621 | 5/1929 | Price | 223/92 |
| 2,441,407 | 5/1948 | Glavies | 70/59 |
| 3,568,479 | 3/1971 | Fleck et al. | 70/59 |
| 3,966,100 | 6/1976 | Nelson | 223/92 |
| 4,073,415 | 2/1978 | Pegg | 223/92 |
| 4,221,798 | 9/1980 | Wright et al. | 223/85 |
| 4,265,380 | 5/1981 | Webster et al. | 223/85 |
| 4,324,352 | 4/1982 | Goldfarb et al. | 223/93 |
| 4,517,709 | 5/1985 | Arentson | 223/85 |

FOREIGN PATENT DOCUMENTS

| | | | |
|---|---|---|---|
| 0017542 | 10/1980 | European Pat. Off. . | |
| 66922 | of 1969 | Fed. Rep. of Germany | 223/85 |
| 2445469 | 4/1976 | Fed. Rep. of Germany | 223/85 |
| 180012 | 11/1954 | Sweden | 223/85 |

*Primary Examiner*—Cornelius J. Husar
*Assistant Examiner*—Anthony Knight
*Attorney, Agent, or Firm*—Michael N. Meller

[57] ABSTRACT

The present invention relates to an anti-theft device for use with a garment-hanger which is intended to be suspended from a rail. The hook (22) of the hanger (10) is fixed to the anti-theft device (12) which itself includes a fixed hook (18) for hooking to the rail (14) together with a moving arm (20) which is lockable by means of a key-operated mechanism (24, 26) in a position in which it prevents the anti-theft device (12) from being removed from the suspension rail (14). The invention is intended for use, in particular, in clothes' shops.

6 Claims, 5 Drawing Figures

IV
IV

ANTI-THEFT DEVICE, IS PARTICULAR FOR A GARMENT-HANGER

The invention relates to an anti-theft device, in particular for a garment-hanger intended for hooking to a rail or the like.

BACKGROUND OF THE INVENTION

Various hanger anti-theft devices are already known, in which a hanger is associated with a cable or a chain having one end fixed to the hanger and having its other end suitable for being received in a housing provided for the purpose on the hanger and for being locked in said housing by means of a key-operated lock mechanism. The free end of the cable is passed through a sleeve of the garment supported on the hanger prior to being locked to the hanger. This device is relatively inconvenient in use since in order to prevent the hanger carrying a garment from being removed from the rail to which it is hooked, the hanger and its garment must be held to one side of the suspension rail and the free end of the cable must be passed round the other side of the rail.

Another type of anti-theft device for a hanger is also known in which the hanger is associated with two moving arms which clamp the shoulders of the garment against the hanger and which are lockable in the clamping position by means of a key-operated locking mechanism. This device has the drawback of crushing the shoulders of the garment against the hanger and thereby deforming or marking them with the ends of the moving arms.

Further, all known anti-theft devices for hangers require the use of special hangers, whereas retailers generally prefer to be able to use their own hangers which are often marked with the name of the retailer or with the name of a fashion house.

Preferred embodiments of the invention provide an anti-theft device, in particular for a garment-hanger, which avoids the drawbacks of known devices, which is simple, cheap, reliable, and which can be adapted to any type of hanger and suspension rail.

SUMMARY OF THE INVENTION

To this end, the invention provides an anti-theft device, in particular for a garment-hanger for hooking to a rail or the like, wherein the anti-theft device is securely fixed to a garment hanger and comprises a lockable means for hooking to the rail, said means having a locked position in which the hanger is prevented from being removed from the rail and an unlocked position in which the hanger may be removed therefrom.

A device in accordance with the invention also includes means for co-operating with a garment on the hanger, suitable for preventing the garment from being removed from the hanger when said hooking means are in the locked position and for enabling the garment to be removed when said hooking means are in the unlocked position.

Advantageously, the anti-theft device comprises a block having a fixed hook for hooking to the rail and a moving arm pivotally mounted on the block between a first position in which said arm is moved away from the free end of the fixed hook by a distance greater than the diameter or the transverse size of the suspension rail, and a second position in which it is moved closer to the free end of the fixed hook and prevents rail passage, locking means being provided on the block to co-operate with the moving arm to lock the arm in its second position.

The block also includes a housing or passage to receive at least a portion of the hanger hook, and means, e.g. a screw, for retaining said hook in said housing or passage.

An anti-theft device in accordance with the invention can thus be fitted to any type of hanger and to any type of suspension rail, thereby enabling retailers to fit devices in accordance with the invention to their own hangers, without having to modify the way in which the suspension rails are fitted in the shop.

In a preferred embodiment of the invention, the device includes a cable or chain having one end fixed to the abovementioned block and whose other end includes a ring capable of passing over the hook which is fixed to the block, said chain or cable being suitable for being passed, for example, through a sleeve of a garment carried by the hanger.

A hanger fitted with a device in accordance with the invention can thus be hooked without difficulty to a suspension rail, and there is no need to pass the hanger and the cable or the chain round opposite sides of the suspension rail.

Further, even if the hanger is broken during an attempted theft, the garment is held locked to the suspension rail by the anti-theft device and its cable or chain and cannot be removed.

Further, when the hanger includes a horizontal cross bar for supporting a garment such as a pair of trousers, the invention provides for retaining means to hold said garment to the horizontal bar, which retaining means are associated with the lockable suspension means.

In order to do this, the moving arm of the device is pivotally connected to the end of a rod which is slidably guided through the block, the other end of said rod being held away from said horizontal bar of the hanger when the moving arm is in its first position and being pressed against said horizontal bar when the moving arm is in its second position.

Such a hanger can therefore be used for a jacket and trousers without it being possible to remove either the jacket or the trousers from the hanger so long as the anti-theft device is in its locked position on the suspension rail.

BRIEF DESCRIPTION OF THE DRAWINGS

An embodiment of the invention is described, by way of example, with reference to the accompanying drawings, in which.

MORE DETAILED DESCRIPTION

Figure 1:
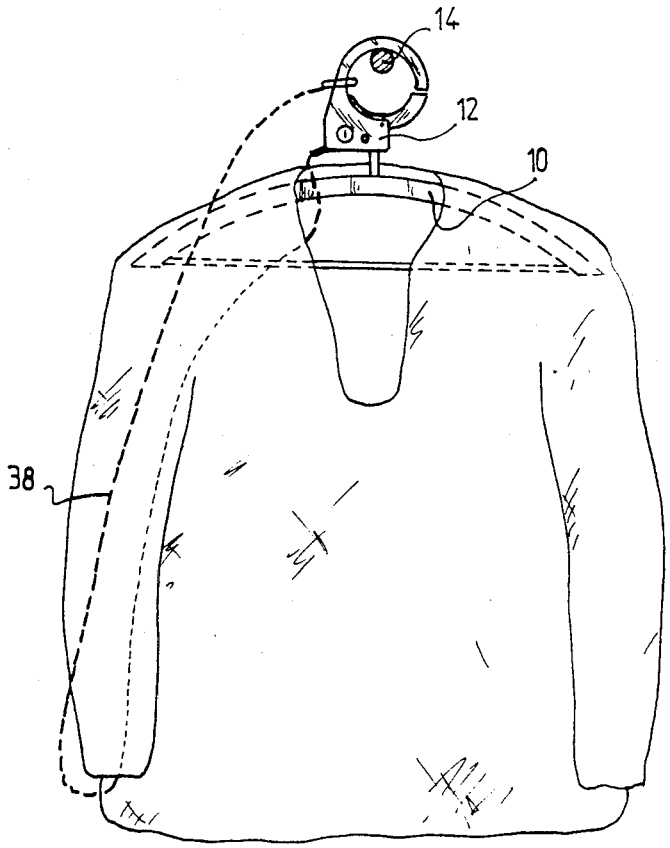
FIG. 1 shows a hanger fitted with an anti-theft device in accordance with the invention and hanging from a rail.

FIG. 1 shows a hanger 10 of conventional type and fitted with an anti-theft device 12 in accordance with the invention. The hanger and its anti-theft device are suspended from a rail 14 which is likewise entirely conventional.

Figures 2, 3, 4:
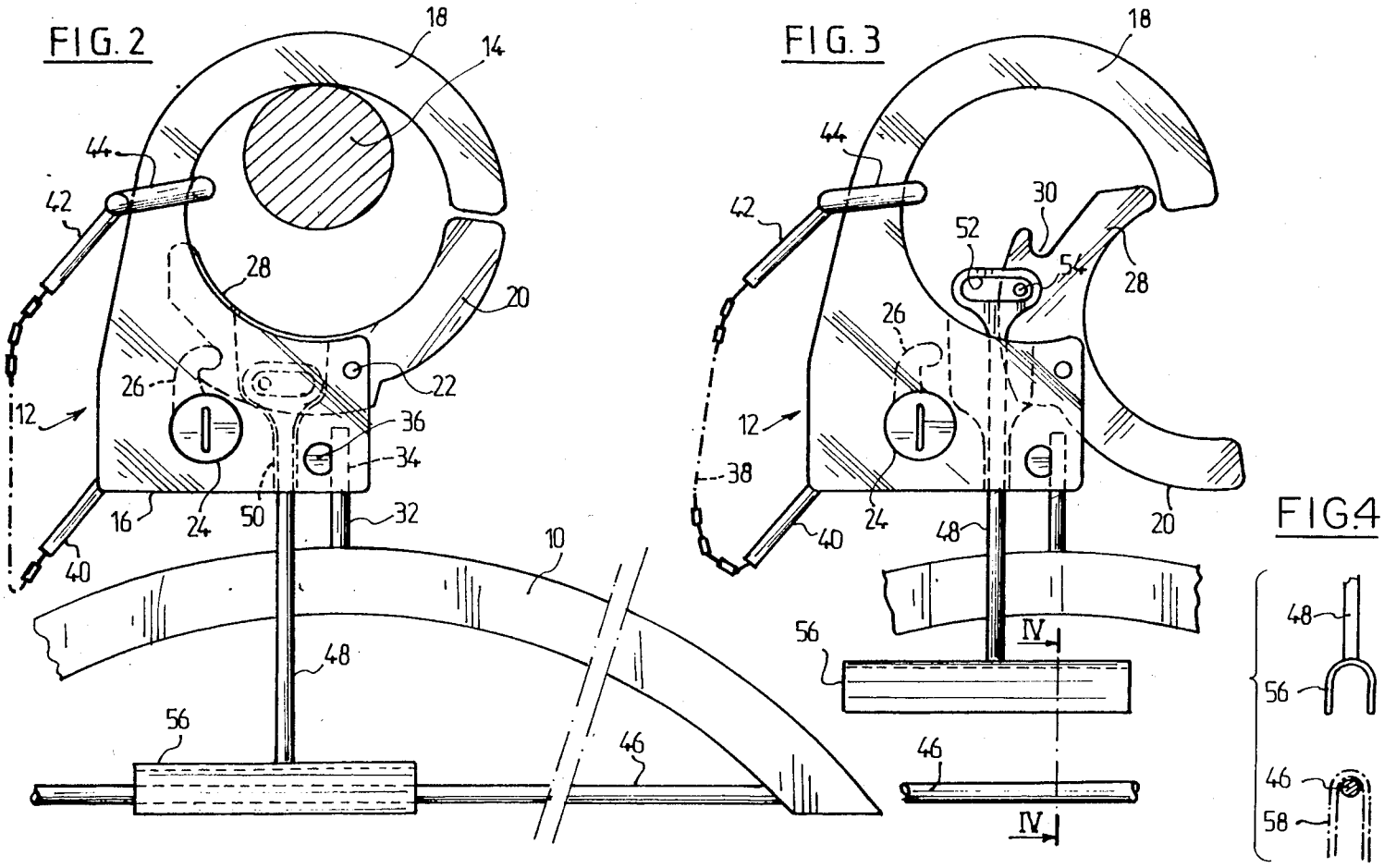
FIG. 2 is a view on a larger scale showing an anti-theft device in with the invention in its locked position.
FIG. 3 is a similar view to FIG. 2, but showing the anti-theft device in its unlocked position.
FIG. 4 is a partial section on a line IV—IV of FIG. 3.

As can more easily be seen in FIGS. 2 and 3, the anti-theft device 12 comprises a block 16 whose upper portion constitutes a fixed hook 18 for suspending from the rail 14, and whose lower portion is provided with a moving arm 20 which is substantially semi-circular in shape and which is pivotally mounted on the block 16 about an axis 22 which is parallel to the axis of the suspension rail 14.

The block 16 is provided with a key-operated locking mechanism 24 of conventional type, said mechanism including a rotary cylinder which is connected to a locking catch 26 for holding the moving arm 20 in its locked position as shown in FIG. 2.

In this position, the moving arm 20 and the fixed hook 18 of the block 16 together constitute a substantially uninterrupted ring which prevents the anti-theft device 12 from being removed from the rail 14. When in the locked position, the left-hand end (as shown in the drawings) of the moving arm 20 is received in a housing in the block 16 which also receives the catch 26. Said left-hand end 28 has a notch 30 which receives the hooked end of the catch 26.

The catch 26 may be pivoted anti-clockwise (as shown in the drawings) by inserting an appropriate key in the lock 24, thereby releasing the notch 30 of the moving arm 20 and thus releasing the moving arm to pivot about the axis 22 in a clockwise direction, e.g. under the action of an associated return spring.

The right-hand end of the moving arm 20 thus moves away from the end of the fixed hook 18 by a distance which is greater than the diameter or the transverse dimension of the suspension rail 14, thereby enabling the anti-theft device to be removed from the suspension rail.

The locking mechanism 24 locks automatically, i.e. when the key is removed from the mechanism the catch 26 is immediately urged towards its locking position, e.g. by a return spring. If the moving arm 20 is then pivoted about its axis 22 in the anti-clockwise direction, its left-hand portion 28 returns to the position shown in FIG. 2 and is again locked in position by engaging the catch 26.

When the device is the position shown in FIG. 3, it can readily be locked to a suspension rail 14 by pressing the left-hand portion 28 of the moving arm against the rail, and locking takes place automatically on returning to the position shown in FIG. 2.

The hanger 10 is fixed to the anti-theft device 12 by its own suspension hook 32.

To do this, the block 16 includes, for example, a housing or passage 34 in which a portion of the hook 32 of the hanger 10 is engaged. Locking means are provided on the block 16 to retain said portion of the hook 32 in the housing 34. Said locking means may be constituted, for example, by a screw 36, which is received in a tapped hole extending perpendicularly to the housing 34 and passing therethrough in part, in such a way that forcing the screw 36 tight therein firmly locks the portion of hook 32 in the housing 34. The screw 36 may be of the type which cannot be unscrewed, e.g. by virtue of its head breaking when the screwing force exceeds a predetermined threshold.

The housing 34 formed in the block 16 may be a simple cylindrical blind hole, in which case it is necessary to cut off the curved portion of the hook 32 of the hanger 10 so that only the rectilinear portion of the hook is inserted into the housing 34.

However, the housing 34 may also be designed to receive the curved portion of the hanger hook 32, in which case there is no need to cut off the curved portion prior to fixing the hanger in the anti-theft device 12.

The device in accordance with the invention also includes a cable or chain or the like 38 having one end 40 which is securely fixed to the block 16 and whose other end 42 includes a ring 44 suitable for being threaded over the fixed hook 18 of the anti-theft device 12, as shown in FIGS. 2 and 3.

Naturally, the size of the ring 44 is such that it cannot be passed between the end of the fixed hook 18 and the end of the moving arm 20 when the anti-theft device is in its locked position.

The cable or the like 38 is used in conventional manner, i.e. it is passed through a sleeve of the garment supported by the hanger (as shown in FIG. 1) and the ring 44 is then threaded over the hook 18. However, unlike known prior devices, it is then necessary merely to engage the anti-theft device 12 with the suspension rail without it being necessary to pass the hanger from one side of the rail and the free end of the cable round the other side of the same rail.

Furthermore, when the device is locked on the rail (see FIG. 2), the garment carried by the hanger cannot be stolen even if the hanger 10 is separated from the anti-theft device 12, since the cable 38 still retains the garment.

When the hanger 10 includes a horizontal bar 46 interconnecting the ends of the hanger shoulders (as shown in FIG. 2), and intended to support a pair of trousers, for example, the invention provides a substantially vertical rod 48 which is slidably guided through a housing 50 in the block 16 and which has a top end including a horizontal slot 52 in which a peg 54 on the left-hand end 28 of the moving arm 20 is engaged.

The bottom end of the rod 48 may include a horizontal channel section member 56 which is intended to fit astride the horizontal bar 46 of the hanger and to retain a pair of trousers 58 placed over the bar 46 in the conventional manner. When the moving arm 20 is in the locking position shown in FIG. 2, the horizontal member 56 is lowered against the horizontal bar 46 of the hanger or to the immediate vicinity thereof. When the moving arm 20 is in its unlocked position as shown in FIG. 3, the rod 48 is raised and its horizontal member 56 is removed sufficiently far from the horizontal bar 46 to enable a pair of trousers to be put into place on the horizontal bar or to be removed therefrom.

It may be observed, that in the embodiment shown in FIG. 2, the moving arm 20 projects slightly above the corresponding edge of the block 16 when in the locking position. This ensures that the device can be locked automatically simply by pressing the left-hand portion 28 of the moving arm 20 against the suspension rail 14.

Further, it is not essential for the moving arm 20 to extend approximately round a semicircle. An embodiment could be provided in which the moving arm extends over no more than one-fourth of a circle from the pivot axis 22.

Figure 5:
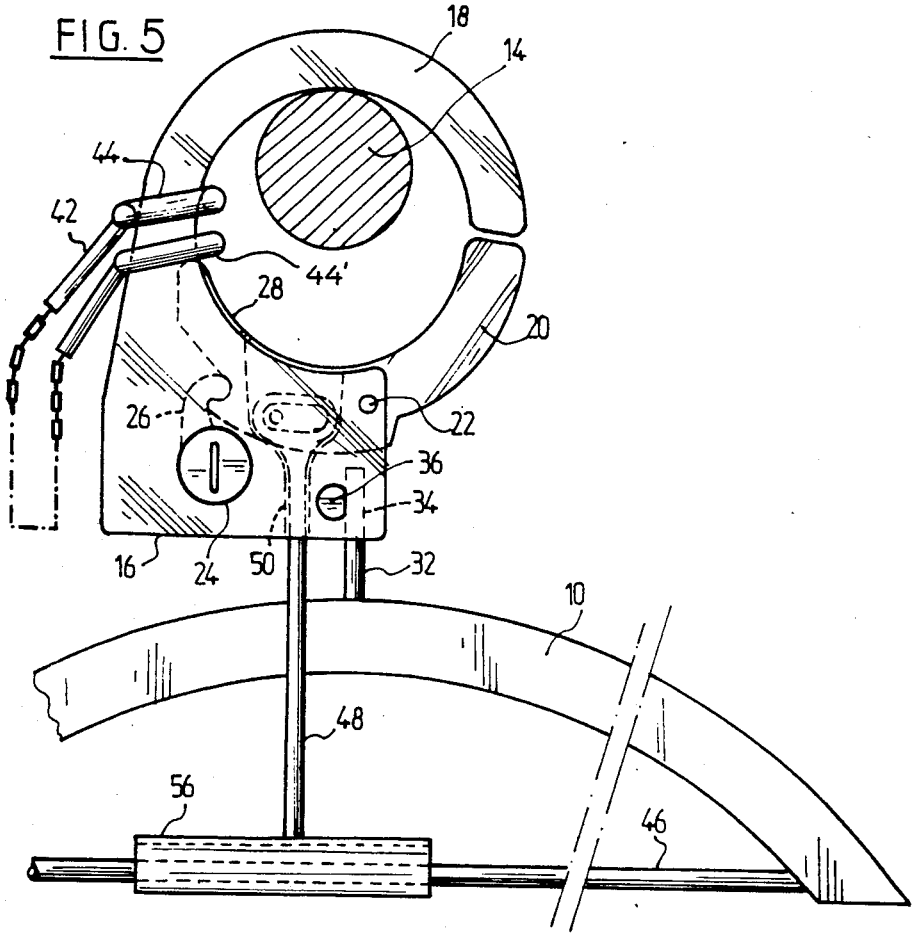
FIG. 5 is a modified version of the embodiment depicted in FIGS. 1–3.

The cable chain 38 may also be provided with rings or similar means at both ends, as shown in FIG. 5 and thus be made independent from the block 16. In order to retain a garment on the anti-theft device, the cable or chain is then passed through the garment and both end rings 44,44' are threaded over the fixed hook 18.

The cable or chain can equally well be passed through a skirt, a trouser leg, etc. and can readily prevent a garment from being stolen.

Further, the right-hand end of the moving arm 20 may itself be hook-shaped or otherwise suitably shaped to engage, when closed, with a portion of complementary shape at the end of the fixed hook 18, thereby strengthening the locking effect.

Numerous modifications may be made to the device which is described above without going beyond the scope of the invention. The essential advantage of the present invention over prior anti-theft devices is that it is readily adaptable to all sorts of hangers and suspension rails.

I claim:

1. An anti-theft device for securely coupling a garment hanger of any type to a rail or the like, said anti-theft device being securely connected to a portion of a hook of said garment hanger and comprising a lockable suspension means suitable for occupying a locked position on the rail preventing the device and the hanger from being removed from the rail, and having an unlocked position enabling the device and the hanger to be removed from the rail, said lockable suspension means comprising a block having a fixed hook for suspending from the rail and a moving arm pivotally mounted on the block between a first position in which it is separated from the free end of the hook by a distance greater than the diameter or the transverse dimension of the rail, and a second position in which it is close to the free end of the hook and prevents the rail from passing through, locking means being provided on the block and co-operating with the moving arm to lock the moving arm in its second position, the block also including a housing or passage for receiving at least a portion of the hook belonging to the hanger, and including means, e.g. a screw, for securely retaining said hook portion in said housing or passage.

2. A device according to claim 1, wherein the means for securely retaining said hook portion in said housing or passage is not removable.

3. A device according to claim 1, including means for cooperating with a garment placed on the hanger to prevent said garment from being removed from the hanger when said lockable suspension means are in the locking position on a rail, and enabling the garment to be removed when said lockable suspension means are in their unlocked position.

4. A device according to claim 3, wherein said means for cooperating with a garment comprise a cable or chain suitable for being passed through a portion of a garment, said cable or chain having a first end securely mounted to the block and having a second end including, for example, a ring threadable over the fixed hook of the block.

5. A device according to claim 3, including a cable or chain suitable for being passed through a portion of the garment, with both ends of said cable or chain being provided with respective rings or the like capable of being threaded over the fixed hook of the block.

6. A device according to claim 1, for a hanger including a horizontal bar for supporting a garment such as a pair of trousers, wherein the moving arm of the lockable suspension means is pivotally connected to one end of a rod which is slidably guided through the block and which has an opposite end held apart from the horizontal bar of the hanger when the moving arm is in a first rotational position and which is substantially in contact with said horizontal bar when the moving arm is in a second rotational position for retaining said garment on said horizontal bar.

* * * * *